US011738388B2

(12) United States Patent
Kawauchi et al.

(10) Patent No.: US 11,738,388 B2
(45) Date of Patent: Aug. 29, 2023

(54) CASTING MOLD FOR DIE CASTING, AND METHOD FOR SETTING DECOMPRESSION PATH CONDUCTANCE THEREOF

(71) Applicant: HONDA MOTOR CO., LTD., Tokyo (JP)

(72) Inventors: Nobuo Kawauchi, Tochigi (JP); Satoru Kimura, Tochigi (JP); Ryo Onishi, Tochigi (JP); Gaku Kazama, Tochigi (JP); Toshihide Sunada, Tochigi (JP)

(73) Assignee: HONDA MOTOR CO., LTD., Tokyo (JP)

( * ) Notice: Subject to any disclaimer, the term of this patent is extended or adjusted under 35 U.S.C. 154(b) by 23 days.

(21) Appl. No.: 17/277,084

(22) PCT Filed: Sep. 21, 2018

(86) PCT No.: PCT/JP2018/035045
§ 371 (c)(1),
(2) Date: Mar. 17, 2021

(87) PCT Pub. No.: WO2020/059113
PCT Pub. Date: Mar. 26, 2020

(65) Prior Publication Data
US 2021/0379651 A1 Dec. 9, 2021

(51) Int. Cl.
*B22D 17/32* (2006.01)
*B22D 17/14* (2006.01)

(52) U.S. Cl.
CPC ..... *B22D 17/32* (2013.01); *B22D 17/14* (2013.01)

(58) Field of Classification Search
CPC ..... B22D 17/14; B22D 17/32
See application file for complete search history.

(56) References Cited

U.S. PATENT DOCUMENTS 5,511,605 A * 4/1996 Iwamoto ..... B22D 17/32 164/155.3
2009/0050289 A1* 2/2009 Lismont ..... B22D 17/14 164/63

FOREIGN PATENT DOCUMENTS

CN 1709613 A 12/2005
EP 1832362 A1 * 9/2007 ..... B22D 17/14
(Continued)

OTHER PUBLICATIONS

International Search Report dated Nov. 13, 2018, 2 pages.
Indian Office Action dated Feb. 1, 2022, 5 pages.

*Primary Examiner* — Kevin E Yoon
(74) *Attorney, Agent, or Firm* — Rankin, Hill & Clark LLP

(57) ABSTRACT

A decompression path conductance factor calculation device 110 obtains a cavity pressure change characteristic representing a pressure change characteristic of a cavity portion 30 from an exhaust speed of a decompression device 70, a cavity conductance factor, an overflow conductance factor, a decompression path conductance factor, and respective volumes of inside spaces of a cavity portion 30, an overflow portion 50, and a decompression path 60, obtains a decompression path pressure change characteristic representing a pressure change characteristic of the decompression path 60 from the exhaust speed of the decompression device 70, the volume of the inside space of the decompression path 60, and the decompression path conductance factor, and obtains the decompression path conductance factor such that a difference between respective approximate curves representing the obtained cavity pressure change characteristic and the obtained decompression path pressure change characteristic becomes a threshold value or less.

3 Claims, 5 Drawing Sheets

(56) References Cited

FOREIGN PATENT DOCUMENTS

| | | | | |
|---|---|---|---|---|
| JP | S56-136342 | A | | 10/1981 |
| JP | 2001-256910 | A | | 9/2001 |
| JP | 2002-166448 | A | | 6/2002 |
| JP | 2006-026698 | A | | 2/2006 |
| JP | 2009-016382 | A | | 1/2009 |
| JP | 2009-255156 | A | | 11/2009 |
| JP | 2011-100786 | A | | 5/2011 |
| KR | 1020170090289 | A | * | 8/2017 |
| WO | 2011/115276 | A1 | | 9/2011 |

* cited by examiner

CASTING MOLD FOR DIE CASTING, AND METHOD FOR SETTING DECOMPRESSION PATH CONDUCTANCE THEREOF

TECHNICAL FIELD

The present invention relates to a casting mold for die casting and a method for setting a decompression path conductance thereof.

BACKGROUND ART

In related art, a casting mold for die casting has been known which has a knockout pin and in which a pressure measurement path is provided, the pressure measurement path communicating with a knockout pin insertion portion through which the knockout pin of the mold is inserted, and a pressure detection unit is directly connected with this pressure measurement path (for example, see Japanese Patent Laid-Open No. 2006-26698).

CITATION LIST

Patent Literature

Patent Literature 1: Japanese Patent Laid-Open No. 2006-26698

SUMMARY OF INVENTION

Technical Problem

In a casting mold for die casting in Japanese Patent Laid-Open No. 2006-26698, because a pressure detection portion is arranged on an outside of a mold, the pressure detection portion is less likely to be subjected to a thermal influence of molten metal, degradation of the pressure detection portion can be inhibited. However, because a pressure of a cavity portion is measured by using an insertion portion through which a knockout pin sliding with respect to the cavity portion and the mold is inserted, air is likely to enter from the outside of the mold when a sealing characteristic of structure portions around the mold is impaired, and it is thus difficult to accurately detect the pressure in an inside of a cavity.

In consideration of the above point, an object of the present invention is to provide a decompression path conductance factor calculation device that can accurately obtain a vacuum degree of a cavity portion by using a pressure detection portion provided in a decompression path on an outside of a mold where a less thermal influence of molten metal is present, a vacuum casting mold for die casting, and a method for setting a decompression path conductance.

Solution to Problem

[1] To achieve the above object, the present invention provides a decompression path conductance factor calculation device for setting conductance of a decompression path in a vacuum casting mold for die casting, the vacuum casting mold for die casting including:

a casting mold which has a cavity portion on an inside;

a molten metal supply unit which supplies molten metal to the cavity portion;

an overflow portion which is provided in a downstream portion of the cavity portion in a passage through which the molten metal flows;

a decompression device which decompresses the cavity portion via the overflow portion;

the decompression path which has an inside decompression path positioned on the inside of the casting mold and an outside decompression path positioned on an outside of the casting mold and which connects the overflow portion with the decompression device; and a pressure detection portion which detects a pressure of the outside decompression path, in which the decompression path conductance factor calculation device for setting conductance of the decompression path defines a factor determining conductance of a space to be decompressed by the decompression device and being determined in accordance with a shape of the space regardless of a pressure of the space as a conductance factor, obtains a cavity pressure change characteristic representing a pressure change characteristic of the cavity portion from a preset exhaust speed of the decompression device, a cavity conductance factor determined in accordance with a shape of the cavity portion, an overflow conductance factor determined in accordance with a shape of the overflow portion, a decompression path conductance factor determined in accordance with a shape of the decompression path, and respective volumes of inside spaces of the cavity portion, the overflow portion, and the decompression path, further obtains a decompression path pressure change characteristic representing a pressure change characteristic of the decompression path from an exhaust speed of the decompression device, the volume of the inside space of the decompression path, and the decompression path conductance factor, and obtains the decompression path conductance factor such that a difference between respective approximate curves representing the obtained cavity pressure change characteristic and the obtained decompression path pressure change characteristic becomes a threshold value or less.

In the present invention, the decompression path conductance factor is obtained such that the difference between the respective approximate curves representing the cavity pressure change characteristic and the decompression path pressure change characteristic becomes the threshold value or less. Thus, by configuring the decompression path such that it has the obtained decompression path conductance factor, for example, calculation of a present pressure of the cavity portion from a present pressure of the decompression path is less likely to be influenced by arithmetic errors than related art, and a vacuum degree of the cavity portion can more accurately be obtained than related art.

[2] Further, a decompression path module of the present invention may be configured to include: the decompression path conductance factor calculation device; the decompression path; the pressure detection portion; and plural kinds of conductance adjustment portions any one of which is selectively interposed in the decompression path and may be configured such that based on the decompression path conductance factor obtained by the decompression path conductance factor calculation device, the conductance adjustment portion which makes the difference between the approximate curves become the threshold value or less is selected from the plural kinds of conductance adjustment portions.

In such a configuration, the conductance adjustment portion is selected such that the difference between the respective approximate curves representing the cavity pressure change characteristic and the decompression path pressure change characteristic becomes the threshold value or less. Thus, by configuring the decompression path such that it, has the obtained decompression path conductance factor, for example, the calculation of the present pressure of the cavity portion from the present pressure of the decompression path is less likely to be influenced by arithmetic errors than related art, and the vacuum degree of the cavity portion can more accurately be obtained than related art.

[3] Further, the present invention provides a vacuum casting mold for die casting in which a conductance adjustment portion is provided in the decompression path so as to provide the decompression path conductance factor which is obtained by the decompression path conductance factor calculation device such that the difference between the approximate curves becomes the threshold value or less and which may be configured such that the conductance adjustment portion includes at least one of an expanding portion, an orifice portion, and a bent portion.

In the present invention, in order to provide the obtained decompression path conductance factor, appropriate selection may be made such that at least one of the expanding portion, the orifice portion, and the bent portion as the conductance adjustment portions is included. Thus, the difference between the respective approximate curves representing the cavity pressure change characteristic and the decompression path pressure change characteristic can easily be made the threshold value or less.

[4] Further, in the casting mold for die casting of the present invention, the conductance adjustment portion is preferably provided in a downstream portion of the pressure detection portion. In such a configuration, because the conductance adjustment portion is positioned in the outside decompression path, adjustment of the conductance adjustment portion becomes easy compared to a case where the conductance adjustment portion is provided in the inside decompression path positioned on the inside of the mold.

[5] Further, the present invention provides a method for setting decompression path conductance of a casting mold for die casting, the casting mold for die casting including:

a casting mold which includes a cavity portion on an inside;

a molten metal supply unit which supplies molten metal to the cavity portion;

an overflow portion which is provided in a downstream portion of the cavity portion in a passage through which the molten metal flows;

a decompression device which decompresses the cavity portion via the overflow portion;

a decompression path which has an inside decompression path positioned on the inside of the casting mold and an outside decompression path positioned on an outside of the casting mold and which connects the overflow portion with the decompression device; and a pressure detection portion which detects a pressure of the outside decompression path, in which the method for setting decompression path conductance includes:

defining a factor determining conductance of a space to be decompressed by the decompression device and being determined in accordance with a shape of the space regardless of a pressure of the space as a conductance factor;

obtaining a cavity pressure change characteristic representing a pressure change characteristic of the cavity portion from a preset exhaust speed of the decompression device, a cavity conductance factor determined in accordance with a shape of the cavity portion, an overflow conductance factor determined in accordance with a shape of the overflow portion, a decompression path conductance factor determined in accordance with a shape of the decompression path, and respective volumes of inside spaces of the cavity portion, the overflow portion, and the decompression path;

further obtaining a decompression path pressure change characteristic representing a pressure change characteristic of the decompression path from an exhaust speed of the decompression device, the volume of the inside space of the decompression path, and the decompression path conductance factor; and adjusting the decompression path conductance factor such that a difference between respective approximate curves representing the obtained cavity pressure change characteristic and the obtained decompression path pressure change characteristic becomes a threshold value or less.

In the present invention, the decompression path conductance factor is obtained such that the difference between the respective approximate curves representing the cavity pressure change characteristic and the decompression path pressure change characteristic becomes the threshold value or less. Thus, by configuring the decompression path such that it has the obtained decompression path conductance factor, for example, the calculation of the present pressure of the cavity portion from the present pressure of the decompression path is less likely to be influenced by arithmetic errors than related art, and the vacuum degree of the cavity portion can more accurately be obtained than related art.

[6] Further, in e present invention, a storage portion is preferably provided which in advance stores plural kinds of conductance adjustment portions for adjusting a conductance coefficient of the decompression path, the conductance adjustment portion is preferably selected such that the difference between the respective approximate curves representing the obtained cavity pressure change characteristic and the obtained decompression path pressure change characteristic becomes the threshold value or less, and the selected conductance adjustment portion is preferably output.

In the present invention, only by selecting the conductance adjustment portion output to a display or the like from plural kinds of conductance adjustment portions and by mounting it on the decompression path, a conductance factor of the decompression path can easily be adjusted to a suitable value.

DESCRIPTION OF EMBODIMENT

[Configuration]

Figure 1:
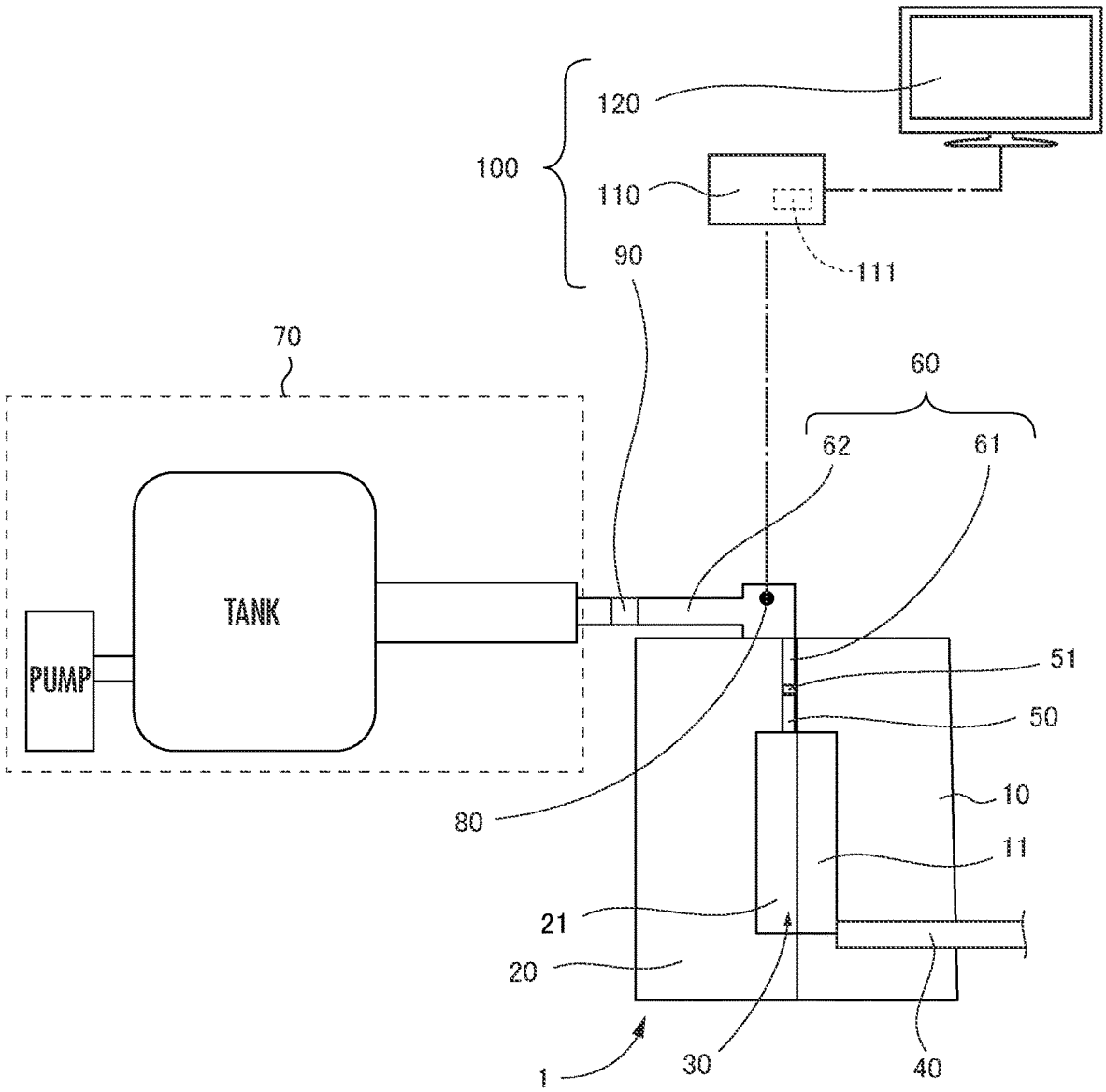
FIG. 1 is a schematic diagram illustrating a vacuum casting mold for die casting of an embodiment of the present invention.

FIG. 1 illustrates a casting mold 1 for die casting of an embodiment of the present invention. The casting mold 1 has a fixed mold 10 and a movable mold 20. The movable mold 20 is disposed on the left side of the fixed mold 10 in FIG. 1 and is capable of moving forward and backward in the lateral direction in FIG. 1 with respect to the fixed mold 10. Recess portions 11 and 21 configuring a cavity portion 30 are respectively formed in mutually opposed surfaces of the fixed mold 10 and the movable mold 20.

In the casing mold 1, when the movable mold 20 is moved forward to the fixed mold 10 side, mold clamping is performed, and a cavity portion 30 is formed on the inside. Further, the casting mold 1 is provided with a sliding mold (not illustrated) which is positioned between the fixed mold 10 and the movable mold 20 and configures a portion of the cavity portion 30. Further, a sealing plate (not illustrated) is mounted on the casting mold 1, the sealing plate covering and tightly sealing boundaries between the fixed mold 10 and the sliding mold (not illustrated) and between the movable mold 20 and the sliding mold (not illustrated) in a mold clamping state.

Further, in order to prevent leakage of air from a gap around a knockout pin (not illustrated) communicating with the cavity portion 30 of the casting mold 1, a portion around the knockout pin (not illustrated) is sealed, or the knockout pin is connected with a decompression path 60.

The fixed mold 10 is provided with a molten metal supply unit 40 which is capable of supplying molten metal to the cavity portion 30. The movable mold 20 is provided with an overflow portion 50 which is positioned in a downstream portion of the cavity portion 30 in a passage through which molten metal flows. The overflow portion 50 is provided with a shutoff valve 51 blocking molten metal. Further, a decompression device 70 is connected with the overflow portion 50 via the decompression path 60.

The decompression path 60 includes an inside decompression path 61 positioned on the inside of the casting mold 1 and an outside decompression path 62 positioned on the outside of the casting mold 1. A pressure detection portion 80 formed with a pressure sensor detecting a pressure of the decompression path 60 is provided in an end portion on a side, of the outside decompression path 62, connected with the inside decompression path 61. The pressure detection portion 80 is arranged on the outside of the casting mold 1, thereby inhibiting transmission of heat of the casting mold 1 to the pressure detection portion 80.

Further, the outside decompression path 62 is provided with a conductance adjustment portion 90 which is positioned in a downstream portion of the pressure detection portion 80 in an exhaust passage of the decompression device 70. The conductance adjustment portion 90 includes at least one of a diameter-enlarged portion, an orifice portion, and a bent portion. For example, the conductance adjustment portion 90 may be configured by plural kinds among the diameter-enlarged portion, the orifice portion, and the bent portion, respectively having different values of conductance factors Cf. The conductance adjustment portion 90 provided to open in the outside decompression path 62 may appropriately be selected in accordance with a decompression path conductance factor Cf required for the decompression path 60.

A pressure signal detected by the pressure detection portion 80 is sent to a decompression path conductance factor calculation device 110. The decompression path conductance factor calculation device 110 is an electronic unit configured with a CPU, a memory, and so forth, executes a calculation program retained in the memory by the CPU, and thereby provides a function of calculating a pressure of the cavity portion 30 based on the pressure of the decompression path 60.

Here, a factor determining a conductance C of a space to be decompressed by the decompression device 70 and being determined in accordance with a shape of the space regardless of a pressure of the space will be defined as a conductance factor Cf.

The conductance C denotes easiness of flow of gas, and the conductance C changes every moment due to the change in a vacuum degree. For example, the conductance C of a viscous flow flowing in a cylindrical pipe with a diameter d and a length l is in general obtained by the following formula (1).

$$C=1349d^4P/l(m^3/s) \quad \text{formula (1)}$$

Here, d: diameter of cylindrical pipe (m), l: length of cylindrical pipe (m), and P: average pressure (Pa).

Moreover, among factors for obtaining the conductance C in the mold 1 or the decompression path 60, the conductance factor Cf (or a conductance coefficient) as a factor determined in accordance with only the shape in the mold 1 or the decompression path 60 regardless of the pressure will be represented by the following formula (2) resulting from removal of an average pressure P (Pa) from formula (1).

$$Cf=1349d^4/l(m^3) \quad \text{formula (2)}$$

The decompression path conductance factor calculation device 110 can obtain a cavity pressure change characteristic representing a pressure change characteristic of the cavity portion 30, the pressure change characteristic corresponding to a lapse of time, from a preset exhaust speed of the decompression device 70, a cavity conductance factor determined in accordance with a shape of the cavity portion 30, an overflow conductance factor determined in accordance with a shape of the overflow portion 50, a decompression path conductance factor determined in accordance with a shape of the decompression path 60, respective volumes of inside spaces of the cavity portion 30, the overflow portion 50, and the decompression path 60, and the pressure detected by the pressure detection portion 80.

Further, the decompression path conductance factor calculation device 110 can obtain a decompression path pressure change characteristic representing a pressure change characteristic of the decompression path 60, the pressure change characteristic corresponding to a lapse of time, from an exhaust speed of the decompression device 70, the volume of the inside space of the decompression path 60, and the decompression path conductance factor.

Moreover, the decompression path conductance factor calculation device 110 can obtain the decompression path conductance factor required to make the difference between respective approximate curves of the obtained cavity pressure change characteristic and the obtained decompression path pressure change characteristic become a threshold value or less.

The decompression path conductance factor calculation device 110 incorporates a storage portion 111 in which plural kinds of conductance adjustment portions 90 are stored while being associated with their own conductance factors. Moreover, the decompression path conductance factor calculation device 110 selects a suitable conductance adjustment portion 90 from the storage portion 111 based on the obtained decompression path conductance factor and outputs information of the selected conductance adjustment portion 90 to a guide portion 120 such as a display. Accordingly, a user can easily select a suitable conductance adjustment portion 90 and mount it on the outside decompression path 62.

Further, a decompression path module 100 is configured with the decompression path conductance factor calculation device 110, the decompression path 60, the pressure detection portion 80, and the plural kinds of conductance adjustment portions 90 any one of which is selectively interposed in the decompression path 60.

[Action and Method]

Although various casting conditions are possible depending on a component to be casted and a casting device, the vacuum degree in a cavity portion can in advance be obtained which is capable of inhibiting a blowhole defect. In this embodiment, it has been found that in casting of a large casted component such as a cylinder block of an automobile, a casing member covering a drive system, and so forth, the vacuum degree in the cavity portion has to be set to 20 kPa or lower in order to prevent a blowhole defect.

Incidentally, gas which becomes a cause of a blowhole defect may include gas produced from air or molten metal in the cavity portion 30, gas produced due to contact of molten metal with a mold-releasing agent on a surface of the mold 1, and so forth.

Thus, in a vacuum casting mold for die casting, after mold closing of the mold 1 is performed and pouring is performed into a portion referred to as injection sleeve configuring the molten metal supply unit 40, decompression in the cavity portion 30 is started at a timing when a plunger tip (one of configuration elements of the molten metal supply unit 40) injecting molten metal into the cavity portion 30 tightly closes a pouring opening of the injection sleeve. Then, when the cavity portion 30 reaches a predetermined target pressure, pouring into the cavity portion 30 is started. Here, there are various procedures for setting a vacuum stop timing.

Examples may include a procedure in which the cavity portion 30 is filled with molten metal, reaching of molten metal to the overflow portion 50 is thereafter detected, the overflow portion 50 being provided in the downstream portion of the cavity portion 30 in a passage through which molten metal flows, and decompression is performed until the shutoff valve 51 provided in the overflow portion 50 is closed, a procedure in which the shutoff valve 51 is closed immediately before pouring is performed into the cavity portion 30, a method in which a valve for shutting molten metal off is not provided but a chill vent for cooling and solidifying molten metal is provided i e inside decompression path 61, and so forth.

The overflow portion 50 may be in various shapes depending on the casting mold 1 but has a function of stopping molten metal such that molten metal does not blow out to the outside of the mold 1 while discharging a defective portion contacting with the mold 1 in pouring and being cooled and solidified and a defective portion containing gas, which is entrained, to the outside of the cavity portion 30.

The overflow portion 50 in general includes a proper volume and the shutoff valve 51 for shutting molten metal off and is provided in a limited part on the inside of the mold 1, and its suitable structure, volume, and flow path length can be obtained based on results of simulations by CAE (computer aided engineering) or the like.

Here, although the cavity portion 30 molding a product has a comparatively large volume, conductance factors such as volumes and cross-sectional areas of the overflow portion 50 and the inside decompression path 61 are small compared to the cavity portion 30. Thus, when vacuum drawing is performed from the decompression path 60 connected with the overflow portion 50 by the decompression device 70, the inside decompression path 61 and the overflow portion 50 are rapidly decompressed, but time is needed until the cavity portion 30 is decompressed to a target pressure.

Accordingly, in order to shorten a decompression time for the cavity portion 30, an experiment has been performed about whether the time needed for decompression of the cavity portion 30 can be made shorter by setting large the conductance factors such as volumes and cross-sectional areas of inside spaces of the inside decompression path 61 and the overflow portion 50.

In addition, in a case where the pressure detection portion 80 is provided on the outside of the mold 1 so as to avoid a thermal influence, in order to accurately predict the vacuum degree in the cavity portion 30, correction of a detection value of the pressure detection portion 80 has to be performed m consideration of the difference in pressure change characteristic due to the difference in exhaust resistance between the overflow portion 50 and the cavity portion 30 and the difference in the pressure change characteristic due to the difference in the exhaust resistance between the overflow portion 50 and the decompression path 60 connecting the overflow portion 50 with the decompression device 70.

Moreover, it has been found that in casting of automobile products such as a large casted component such as a cylinder block of an automobile and a casing member covering a drive system, as described above, the vacuum degree of the cavity portion 30 has to be set to 20 kPa or lower before casting in order to prevent a blowhole defect.

Further, the conductance factor of the cavity portion 30 for casting an automobile component is about $1.0\times10^{-3}$ to approximately $1.0\times1.0^{-2}$.

Accordingly, in a case of casting a large component such as a cylinder block corresponding to approximately $1.0\times10^{-3}$, the conductance factor of the overflow portion 50 is obtained, and the conductance factor necessary for the decompression path 60 can thereby be obtained, the conductance factor being for making the difference between respective approximate curves of the cavity pressure change characteristic as the pressure change characteristic causing the cavity portion 30 to reach the target pressure and the decompression path pressure change characteristic as the pressure change characteristic causing the decompression path 60 to reach a target pressure become the threshold value or less.

Here, a large decompression path conductance factor is not always good. When the conductance factor of the outside decompression path 62 positioned on a downstream side of the pressure detection portion 80 is too large, a suction speed of the outside decompression path 62 in a downstream area becomes too fast, a pressure of a portion in which the pressure detection portion 80 is arranged is rapidly lowered compared to the cavity portion 30, and the difference in pressure between the pressure detection portion 80 and the cavity portion 30 becomes too large. Thus, the decompression path conductance factor has to be set such that the difference in pressure between the pressure detection portion 80 and the cavity portion 30 does not become too large.

Figure 5:
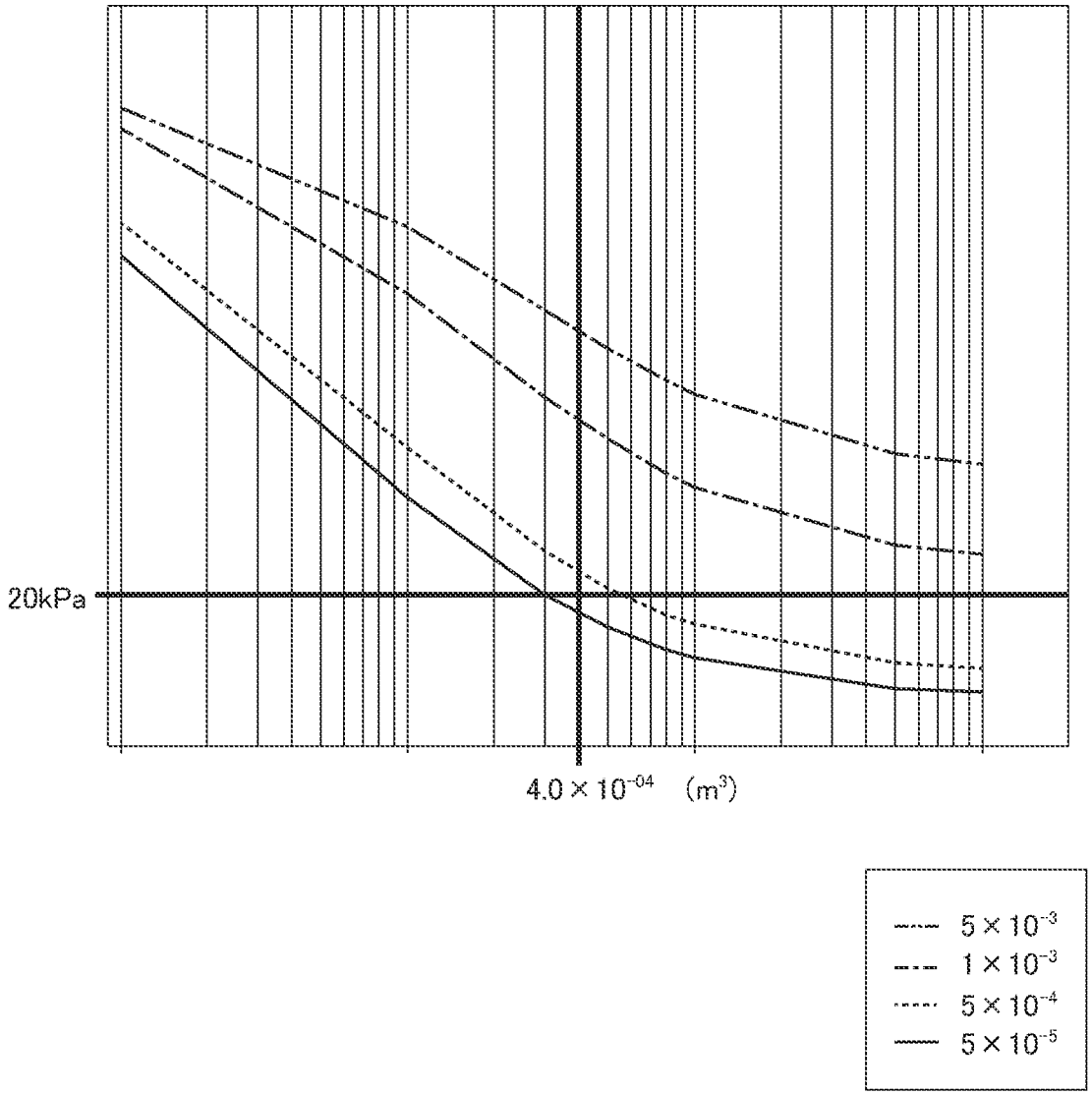
FIG. 5 is a graph representing the decompression path conductance factor in a case where a cavity conductance factor is $1.0\times10^{-3}$ $m^3$, the decompression path conductance factor being capable of lowering a pressure to a target pressure.
Figure 6:
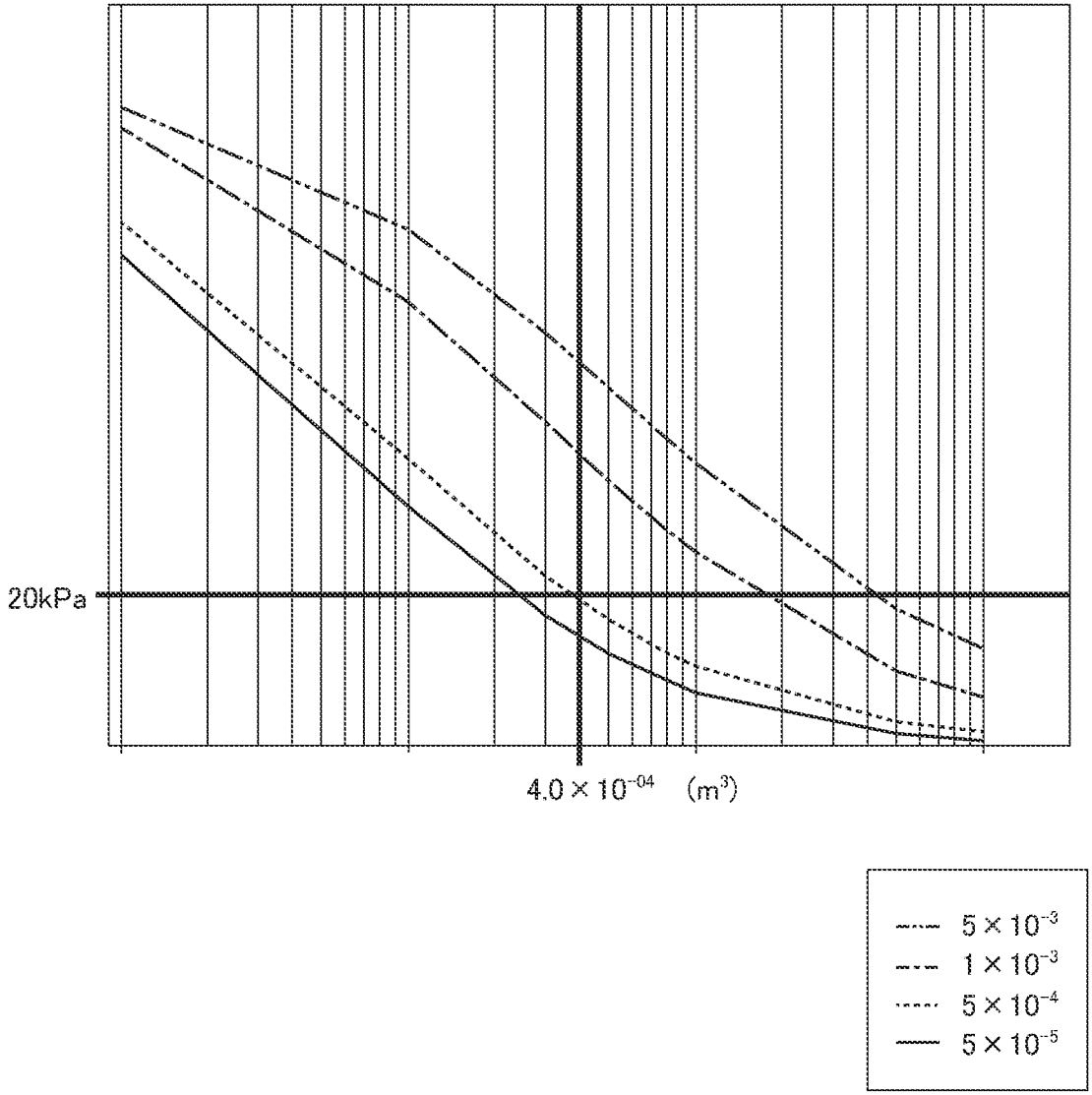
FIG. 6 is a graph representing the decompression path conductance factor in a case where the cavity conductance factor is $1.0\times10^{-2}$ $m^3$, the decompression path conductance factor being capable of lowering the pressure to the target pressure.

In this embodiment, the conductance factor of the overflow portion 50 is set to $4.0\times10^{-4}$. Moreover, as illustrated in FIG. 5, it has been found that when four kinds of conductance factors that are $5\times10^{-3}$ ($m^3$), $1\times10^{3}$ ($m^3$), $5\times10^{-4}$ ($m^3$), and $5\times10^{-5}$($m^3$) are selected as the conductance factors of the decompression path 60 and the vacuum degree of the cavity portion 30 and the vacuum degree of the decompression path are obtained, in order to make the vacuum degree of the cavity portion 30 with a cavity conductance factor of $1.0\times10^{-3}$ become 20 kPa or lower as the target pressure, the conductance coefficient of the decompression path 60 has to be adjusted to approximately $5.0\times10^{-5}$. In FIG. 5 and FIG. 6, the horizontal axes represent the conductance factor of the overflow portion 50, and the vertical axes represent the pressure. The overflow conductance factor of the horizontal axes is represented by a logarithmic scale. The vertical axes representing the pressure indicate a higher pressure toward the upper portions of FIGS. 5 and 6, and the horizontal axes representing the overflow conductance factor indicate a higher conductance from the left sides toward the right sides.

Similarly, as illustrated in FIG. 6, it has been found that in a case where a casing member or the like for which the conductance factor of the cavity portion 30 is $1.0\times10^{-2}$ is casted, similarly, the conductance factor of the decompression path 60 has to be adjusted to $5.0\times10^{-4}$ or less with respect to the conductance factor of the overflow portion 50 of $4.0\times10^{-4}$.

Accordingly, in the casting mold 1 in the present invention, the conductance adjustment portion 90 is provided in the decompression path 60. Specifically, in a case where the conductance factor Cf is made large, the diameter-enlarged portion is desirably provided to the decompression path 60. Further, in a case where it is requested that the conductance factor Cf be small, the orifice portion or the bent portion is desirably provided, for example.

Then, the decompression path conductance factor is obtained such that the difference between respective approximate curves representing the cavity pressure change characteristic and the decompression path pressure change characteristic becomes the threshold value or less. The threshold value is 0.5 kPa to 20 kPa, for example. Then, the conductance adjustment portion 90 is selected such that the obtained decompression path conductance factor is provided and is mounted on the outside decompression path 62.

[Work and Effect]

Figure 2:
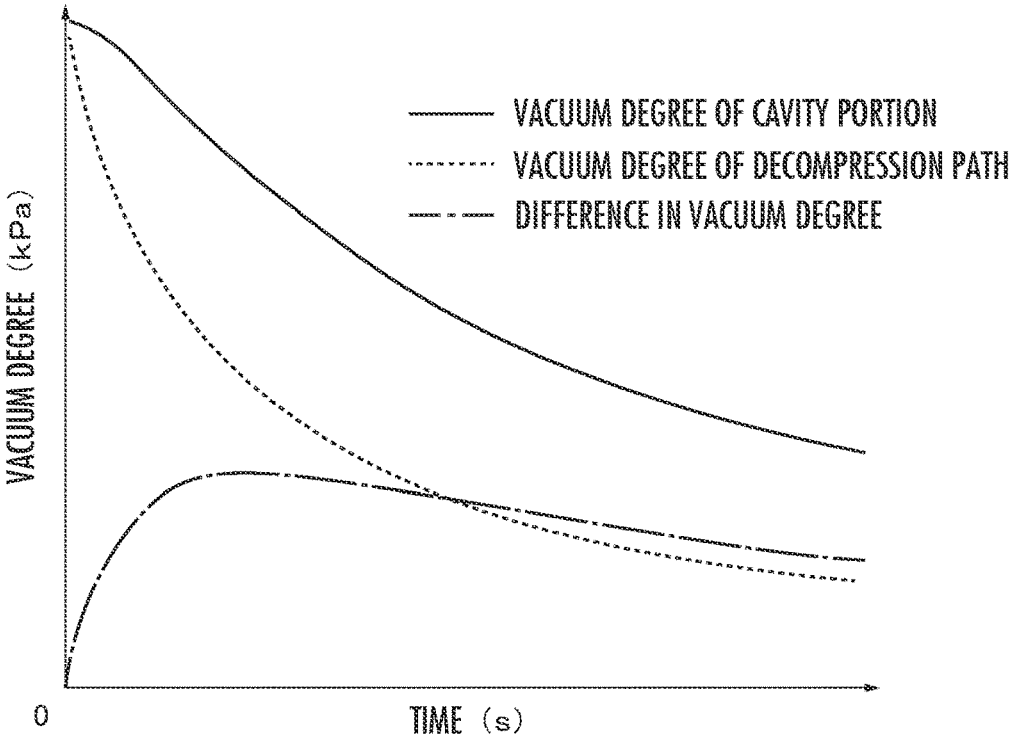
FIG. 2 is a graph representing a state where a decompression path conductance factor has not yet been adjusted.
Figure 3:
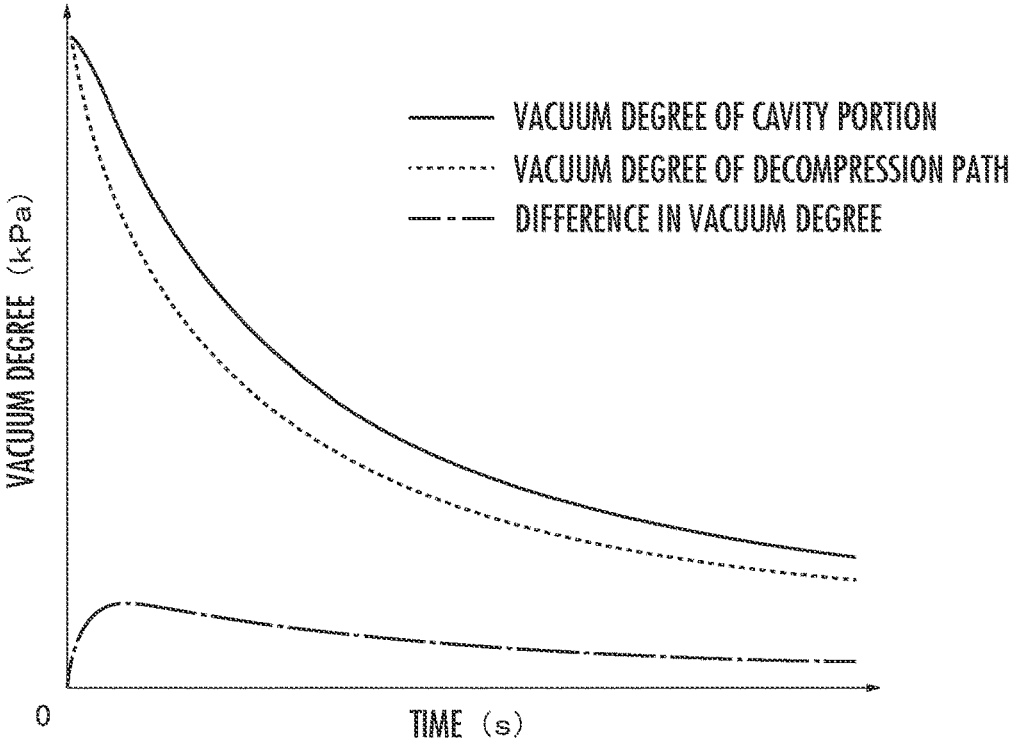
FIG. 3 is a graph representing a state; where the decompression path conductance factor has not yet become a threshold value or less.
Figure 4:
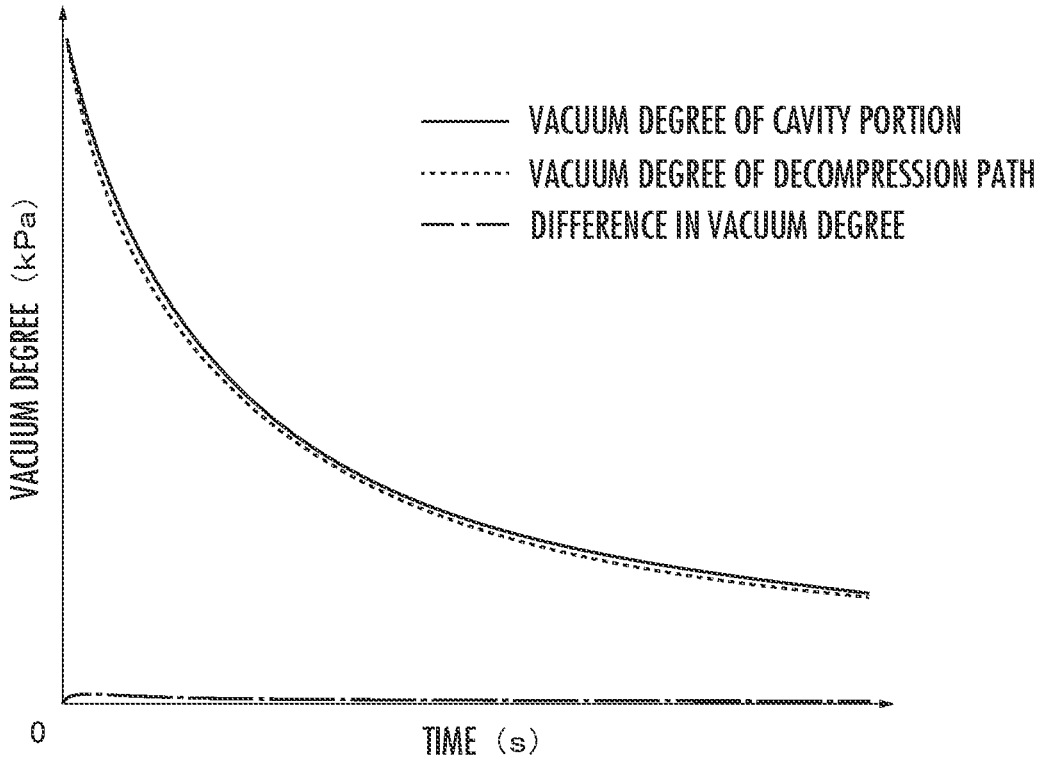
FIG. 4 is a graph representing a state where the decompression path conductance factor has become the threshold value or less.

In the vacuum casting mold for die casting in this embodiment, the decompression path conductance factor is obtained such that the difference between respective approximate curves representing the cavity pressure change characteristic and the decompression path pressure change characteristic becomes the threshold value or less. FIG. 2 to FIG. 4 illustrate a process of adjusting the decompression path conductance factor to the threshold value or less. FIG. 2 illustrates a state where the decompression path conductance factor has not yet been adjusted. It may be understood that the difference between widely separated approximate curves is exhibited. FIG. 3 illustrates a state where the decompression path conductance factor has been adjusted and thereby caused to slightly approach the threshold value. FIG. 4 illustrates a state where the decompression path conductance factor has been adjusted and thereby become the threshold value or less. It may be understood that from FIG. 2 to FIG. 4, the difference between approximate curves becomes smaller.

Moreover, as illustrated in FIG. 4, in this embodiment, the decompression path conductance factor is obtained such that the difference between respective approximate curves representing the cavity pressure change characteristic and the decompression path pressure change characteristic becomes the threshold value or less. Thus, by configuring the decompression path 60 such that it has the obtained decompression path conductance factor, for example, calculation of the present pressure of the cavity portion 30 from the present pressure of the decompression path 60 is less likely to be influenced by arithmetic errors than related art, and the vacuum degree of the cavity portion 30 can more accurately be obtained than related art.

Further, in this embodiment, in order to provide the obtained decompression path conductance factor, appropriate selection may be made such that at least one of an expanding portion, the orifice portion, and the bent portion as the conductance adjustment portions is included. Thus, the difference between respective approximate curves representing the cavity pressure change characteristic and the decompression path pressure change characteristic can easily be made the threshold value or less.

Further, in a casting mold for die casting in this embodiment, the conductance adjustment portion 90 is provided in a downstream portion of the pressure detection portion 80. Accordingly, because the conductance adjustment portion 90 is positioned in the outside decompression path 62, adjustment of the conductance adjustment portion 90 becomes easy compared to a case where the conductance adjustment portion is provided in the inside decompression path 61 positioned on the inside of the mold 1.

Further, in this embodiment, only by selecting the conductance adjustment portion 90 output to the guide portion 120 such as a display from plural kinds of conductance adjustment portions 90 by following an instruction and by mounting it on the decompression path 60, the decompression path conductance factor can easily be adjusted to a suitable value.

Further, in the casting mold for die casting in this embodiment, because the conductance of the decompression path 60 is suitably adjusted by the conductance adjustment portion 90, the pressure of the cavity portion 30 can quickly be lowered to the target pressure.

The conductance adjustment portion of the present invention is not limited to the diameter-enlarged portion, the orifice portion, or the bent portion but may be another portion such as a flow regulating valve as long as it can adjust a conductance factor.

Further, in this embodiment, a description is made about a case where the conductance adjustment portion 90 is provided in the outside decompression path 62. However, the conductance adjustment portion of the present invention is not limited to such a case. For example, even if the conductance adjustment portion is provided in the inside decompression path 61 and the conductance adjustment portion is positioned on an upstream side of the pressure detection portion, work and effect of "the vacuum degree of the cavity portion can more accurately be obtained than related art" of the present invention can be obtained.

Further, the guide portion 120 is not limited to a display but may be another portion. For example, the guide portion 120 may be a notification such as sound guidance, lighting of a lamp, or a code number.

REFERENCE SIGNS LIST

1 mold
10 fixed mold
11 recess portion

20 movable mold
21 recess portion
30 cavity portion
40 molten metal supply unit
50 overflow portion
51 shutoff valve
60 decompression path
61 inside decompression path
62 outside decompression path
70 decompression device
80 pressure detection portion
90 conductance adjustment portion
100 decompression path module
110 decompression path conductance factor calculation device
111 storage portion
120 guide portion

The invention claimed is:

1. A decompression path conductance factor calculation device for setting conductance of a decompression path in a vacuum casting mold for die casting, the vacuum casting mold for die casting including:

a casting mold which has a cavity portion on an inside;

a molten metal supply unit which supplies molten metal to the cavity portion;

an overflow portion which is provided in a downstream portion of the cavity portion in a passage through which the molten metal flows;

a decompression device which decompresses the cavity portion via the overflow portion;

the decompression path which has an inside decompression path positioned on the inside of the casting mold and an outside decompression path positioned on an outside of the casting mold and which connects the overflow portion with the decompression device; and a pressure detection portion which detects a pressure of the outside decompression path, wherein the decompression path conductance factor calculation device for setting conductance of the decompression path defines a factor determining conductance of a space to be decompressed by the decompression device and being determined in accordance with a shape of the space regardless of a pressure of the space as a conductance factor, the decompression path conductance factor calculation device comprises a processor and a memory, the memory stores a plurality of conductance factors respectively associated with plural kinds of conductance adjustment portions, the processor of the decompression path conductance factor calculation device is programmed to execute a calculation program retained in the memory to:

obtain a cavity pressure change characteristic representing a pressure change characteristic of the cavity portion from a preset exhaust speed of the decompression device, a cavity conductance factor determined in accordance with a shape of the cavity portion, an overflow conductance factor determined in accordance with a shape of the overflow portion, a decompression path conductance factor determined in accordance with a shape of the decompression path, respective volumes of inside spaces of the cavity portion, the overflow portion, and the decompression path, and the pressure detected by the pressure detection portion;

obtain a decompression path pressure change characteristic representing a pressure change characteristic of the decompression path from an exhaust speed of the decompression device, the volume of the inside space of the decompression path, the decompression path conductance factor, and the pressure detected by the pressure detection portion; and obtain the decompression path conductance factor which is required to make a difference between respective approximate curves representing the obtained cavity pressure change characteristic and the obtained decompression path pressure change characteristic becomes a threshold value or less.

2. A decompression path module comprising:

the decompression path conductance factor calculation device according to claim 1;

the decompression path;

the pressure detection portion; and the plural kinds of conductance adjustment portions any one of which is selectively interposed in the decompression path, wherein based on the decompression path conductance factor obtained by the decompression path conductance factor calculation device, a conductance adjustment portion, among the plural kinds of conductance adjustment portions, which makes the difference between the approximate curves becomes the threshold value or less is selected from the plural kinds of conductance adjustment portions.

3. A method for setting decompression path conductance of a casting mold for die casting, the casting mold for die casting including:

a casting mold which includes a cavity portion on an inside;

a molten metal supply unit which supplies molten metal to the cavity portion;

an overflow portion which is provided in a downstream portion of the cavity portion in a passage through which the molten metal flows;

a decompression device which decompresses the cavity portion via the overflow portion;

a decompression path which has an inside decompression path positioned on the inside of the casting mold and an outside decompression path positioned on an outside of the casting mold and which connects the overflow portion with the decompression device; and a pressure detection portion which detects a pressure of the outside decompression path, wherein the method for setting decompression path conductance comprises:

defining a factor determining conductance of a space to be decompressed by the decompression device and being determined in accordance with a shape of the space regardless of a pressure of the space as a conductance factor;

obtaining a cavity pressure change characteristic representing a pressure change characteristic of the cavity portion from a preset exhaust speed of the decompression device, a cavity conductance factor determined in accordance with a shape of the cavity portion, an overflow conductance factor determined in accordance with a shape of the overflow portion, a decompression path conductance factor determined in accordance with a shape of the decompression path, and respective volumes of inside spaces of the cavity portion, the overflow portion, and the decompression path;

obtaining a decompression path pressure change characteristic representing a pressure change characteristic of the decompression path from an exhaust speed of the decompression device, the volume of the inside space of the decompression path, and the decompression path conductance factor; and adjusting the decompression path conductance factor such that a difference between respective approximate curves representing the obtained cavity pressure change characteristic and the obtained decompression path pressure change characteristic becomes a threshold value or less, wherein a storage portion is provided which in advance stores a plurality of conductance factors respectively associated with plural kinds of conductance adjustment portions, the conductance adjustment portion is selected such that the difference between the respective approximate curves representing the obtained cavity pressure change characteristic and the obtained decompression path pressure change characteristic becomes the threshold value or less, and the selected conductance adjustment portion is output.

* * * * *